United States Patent [19]

Pfarrwaller

[11] 3,939,878

[45] Feb. 24, 1976

[54] GRIPPER SHUTTLE FOR WEFT YARNS

[75] Inventor: Erwin Pfarrwaller, Winterthur, Switzerland

[73] Assignee: Sulzer Brothers Limited, Winterthur, Switzerland

[22] Filed: Oct. 21, 1974

[21] Appl. No.: 516,507

[30] Foreign Application Priority Data

Oct. 23, 1973 Switzerland ..... 14908/73

[52] U.S. Cl. ..... 139/125

[51] Int. Cl.[2] ..... D03J 5/06

[58] Field of Search.... 139/122 R, 125, 126, 196 R, 139/196 A, 197

[56] References Cited

UNITED STATES PATENTS 2,881,806 4/1959 d'Ornelas Abreu..... 139/196 A 3,237,653 3/1966 Klein et al. ..... 139/125

3,472,286 10/1969 Schneider ..... 139/125

*Primary Examiner*—Henry S. Jaudon

*Attorney, Agent, or Firm*—Kenyon & Kenyon Reilly Carr & Chapin

[57] ABSTRACT

The shuttle is formed with a nose member which overlaps the front edges of the housing while being disposed within the projected plane of the housing. The housing may also be compressed between the pin and nose member to press the mating surfaces of the housing and nose member together. Gaskets may also be used between the nose member and housing or between the pin and housing to effect a resilient connection.

15 Claims, 8 Drawing Figures

GRIPPER SHUTTLE FOR WEFT YARNS

This invention relates to a gripper shuttle for picking weft yarns in a weaving machine particularly weaving machines in which the weft supply remains outside a shed during weaving.

As is known, gripper shuttles normally consist of a generally tubular shuttle body or housing, a gripping mechanism within the body, and a nose portion closing the front end of the shuttle body. It has also been proposed, for example in British Pat. Specification No. 1,143,888, to make the shuttle body of a plastics material, such as polyethylene or polytetrafluoroethylene. Since the nose portion and the gripping mechanism are generally made of metal, the use of a plastics shuttle body makes the shuttle nose heavy. This improves the dynamic behavior of the shuttle as the shuttle passes through the teeth of a shuttle race. Also, the total weight of the shuttle is reduced, which allows a higher picking speed for a given picking energy.

The external surface of the nose portion should ideally merge smoothly into the surface of the plastics shuttle body. However, in the previously proposed shuttles, it is difficult to maintain this condition throughout the life of a shuttle. In some cases, the front end of the plastics shuttle body may become upset, or a gap may appear between the shuttle body and the nose portion. Consequently, there is a risk of the warp threads being damaged by the shuttle.

Accordingly, it is an object of the invention to prevent a gap from forming between the housing and nose member of a multi-component gripper shuttle.

It is another object of the invention to avoid upsetting of a nose member of a gripper shuttle relative to a housing of the shuttle.

It is another object of the invention to reduce the risk of a gripper shuttle damaging wrap yarns in a shed of a weaving machine during a picking operation.

Briefly, the invention provides a gripper shuttle with a housing of generally tubular construction, a nose member which projects from a front end of the housing and includes surfaces which engage corresponding surfaces of the housing, and a means for securing the nose member to the housing to press the surfaces of the housing and nose member together under a longitudinally directed compressive force. The means for securing the nose member to the housing is in the form of a spigot which is received in the front end of the housing and which is integrally formed with the nose member. In addition, the securing means includes a pin which is disposed in bores of the spigot and housing to retain the spigot in the housing.

In order to press the housing against the nose member, the bore in the spigot is disposed relative to the bores in the housing in a direction towards the front end so as to place the housing under a compressive force between the pin and nose member. This produces a prestressing of the shuttle body which ensures that a gap will not appear between the nose member and the shuttle body, even if some creep of the shuttle components should occur. This arrangement also provides a reliable connection that can easily be assembled or released for dismantling.

The surfaces of the nose member which engage the housing are disposed as inwardly and rearwardly facing surfaces to overly at least a part of a forward edge of the housing front end. The inclination of the surfaces of the nose member ensures that the front end of the shuttle body is retained in position, and cannot become upset.

In a preferred construction, the shuttle body is of a tough impact-resistant plastics material. As well as the advantages previously mentioned, the resilience of the plastics material may make it unnecessary to provide special resilient components in a shuttle which is to be prestressed. Plastics materials which have proved satisfactory are polyethylene and polytetrafluoroethylene which, advantageously, can be reinforced with glass fibers or contain fine glass pellets. Materials of this kind have the required strength and resilience, plus very advantageous rubbing and sliding properties which can be controlled by the nature and amount of the glass loading and which are very important for correct shuttle behavior in the catching brake and when passing through the teeth of the shuttle race. The shuttle body may alternatively be made of a metal, such as steel or an aluminum alloy, or a sintered material. In this case, resilience may be provided by a resilient insert.

The front end of the shuttle may have a reduced external cross-section. Preferably, this is achieved by providing outwardly and forwardly facing inclined surfaces, which engage the inclined surfaces of the nose member. When the shuttle housng is of generally oblong transverse cross-section, at least those parts of the front end of the shuttle housing which extend along the wider sidewalls of the housing engage the inclined surfaces on the nose member. This is desirable because it is the wider sidewalls of the shuttle housing which come closest to the wrap threads during picking, and which cooperate with the jaws of the catching brake. The transverse thickness of the shuttle housing measured between the wider sidewalls may then be greater than the greatest dimension of the nose member measured in the same direction. The teeth of the shuttle race and the jaws of the catching brake will touch only the shuttle housing of such a shuttle. If the shuttle housing is made of a plastics material, there is then no risk at all of producing metal particles by metal-to-metal abrasion. Also, lubrication of the shuttle can be largely or completely dispensed with, thereby eliminating the risk of oil soiling the produced cloth.

In one embodiment, the inclined surfaces of the nose member may be curved about an axis extending perpendicularly to the wider sidewalls of the shuttle housing and located to the rear of the nose member. This allows the nose member to be made shorter, measuring along the longitudinal center line of the shuttle, for a given weight of the nose member. The securing pin for the nose member can therefore be positioned closer to the front of the nose member, allowing more room for the gripping mechanism.

In a preferred construction, the spigot forms a yoke connecting two gripper spring arms which are housed within the shuttle housing and carry gripping jaws at their free ends. Since the force which the spring arms can exert on the jaws when closed is limited by the stress which will occur in the arms when the jaws are opened longer more flexible arms will allow higher gripping forces to be obtained.

The use of curved inclined surfaces on the nose member may allow the gripper spring arms and yoke to pivot about the securing pin, whereas planar surfaces will fix the position of the yoke. Since it is desirable for the gripping jaws to be positioned symmetrically in the shuttle to ensure that the weft yarn is correctly transferred from the yarn feeder, the shuttle housing may contain an abutment between the gripper spring arms. The abutment need not be arranged so that both spring arms contact the abutment at once. There is usually a tolerance on the position of the gripping jaws, and a clearance corresponding to this tolerance an be allowed.

The abutment may for part of a wall joining the wider sidewalls of the shuttle housing and extending over a substantial part of the length of the shuttle. This stiffens the shuttle housing considerably, and therefore helps the shuttle to withstand forces such as those imposed by picking and catching.

These and other objects and advantages of the invention will become more apparent from the following detailed description and appended claims taken in conjunction with the accompanying drawings in which:

The same reference numbers will be used in the following description to identify similar parts of different embodiments.

Figures 1, 2, 3, 4:
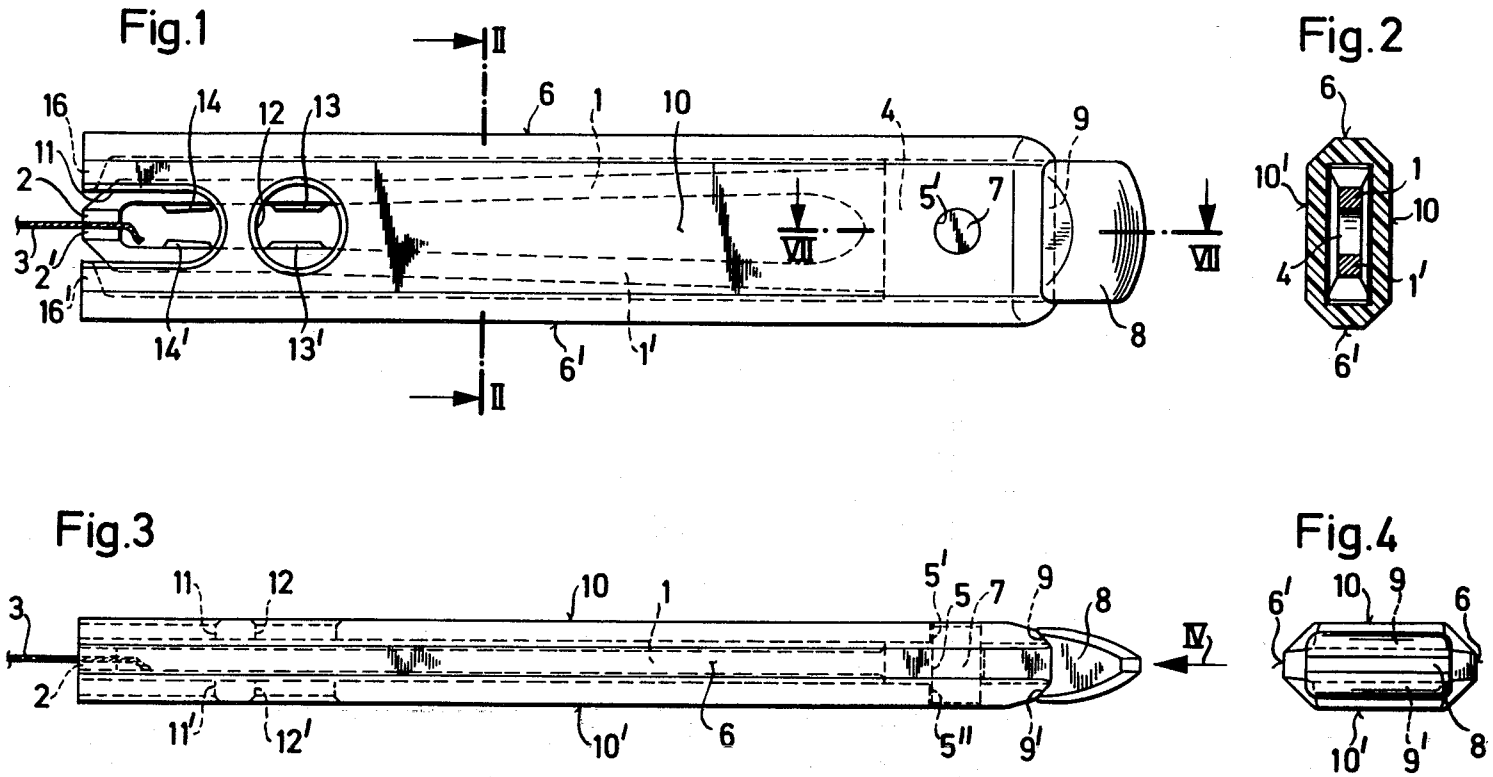
FIG. 1 illustrates a shuttle embodying the invention viewed in a direction perpendicular to a wide sidewall.
FIG. 2 illustrates a sectional view through the shuttle of FIG. 1 taken on line II—II of FIG. 1.
FIG. 3 illustrates a view of the shuttle of FIG. 1 in a direction perpendicular to one of the narrow sidewalls.
FIG. 4 illustrates a view looking onto the nose end of the shuttle taken in the direction indicated by the line IV of FIG. 3.

Referring to FIG. 1, the gripper shuttle has a sleeve-like shuttle housing of tubular construction which is of oblong, e.g. rectangular, cross-section having four sidewalls 6, 6′, 10, 10′ and is made of a resilient material, such as a glass-reinforced plastics material. The wider sidewalls 10, 10′ are formed with oppositely aligned bores 5′, 5″. In addition, the shuttle has a metal nose member 8 at the front end of the housing which is secured to the housing by a spigot. The spigot is in the form of a yoke 4 which is integrally formed with the nose member 8 and which, in turn, is secured to the housing by a securing pin 7 which may, for example, be made of a tough plastic material. The pin 7 is disposed into bores 5, 5′, 5″ within the yoke 4 and housing to connect the shuttle housing to the yoke 4. The nose member 8 which provides weight at the leading end of the shuttle can alternatively be manufactured separately from the yoke 4 and subsequently connected to the yoke 4 for example, by electron beam welding.

The gripper shuttle also includes a gripper spring having two rearwardly-directed resilient arms 1, 1′, each of which carries a clamping jaw 2, 2′ at the free end. The jaws 2, 2′ are pressed together by the resilience of the arms 1, 1′ so that the end of a weft thread 3 may be retained between the jaws 2, 2′. The other ends of the spring arms 2, 2′ are rigidly interconnected by the yoke 4.

The nose member 8 is thicker in the direction of viewing FIG. 1 than is the yoke 4. Those parts of the rear surface of the nose member 8 which lie outside the thickness of the yoke 4 are inclined outwardly and rearwardly to the center line of the shuttle, for example, at an angle of about 45°. Thus, as can be seen from FIG. 7, the nose 8 has two barb-like projections at the rear end. The front end of the shuttle housing is correspondingly tapered, so that when assembled, the front ends of the wide sidewalls 10, 10′ fit against the rear surfaces 9, 9′ of the projections and are inclined outwardly and face forwardly. In this embodiment, the surfaces 9, 9′ are planar, and extend generally at right angles to the narrow side walls 6, 6′.

Figure 7:
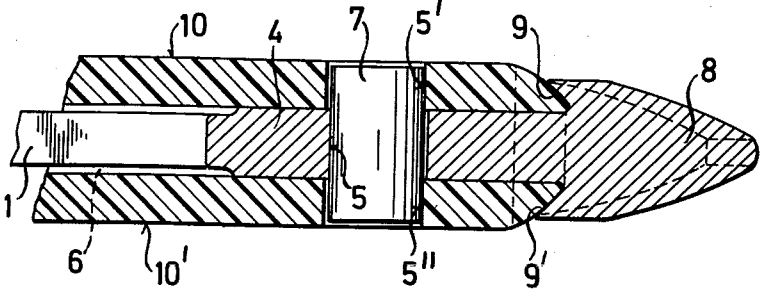
FIG. 7 illustrates a sectional view to an enlarged scale taken on line VII—VII of FIG. 1.

In order to ensure that the shuttle housing is firmly pressed against the surfaces 9, 9′, the positions of the bores 5, 5′, 5″ are so chosen that when the front end of the shuttle housing is just touching the surfaces 9, 9′, without being stressed, the bore 5 in the yoke 4 is one or a few tenths of a millimeter nearer the surfaces 9, 9′ than are the bores 5′, 5″ in the wide sidewalls 10, 10′. On assembly, the shuttle housing is pushed from the rear, i.e. from the left in the drawings, over the spring arms 1, 1′ and pressed so strongly against the surfaces 9, 9′ by an external force acting in the same direction, that the three bores 5, 5′, 5″ are brought into line by longitudinal compression of the shuttle housing. The pin 7 is then inserted into the bores 5, 5′, 5″. FIG. 7 shows the relative position of the parts after assembly.

Figure 8:
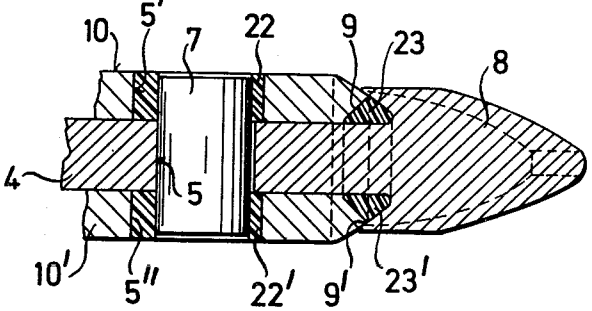
FIG. 8 illustrates a sectional view similar to FIG. 7 but showing another embodiment of the invention.

The shuttle housing may alternatively be made of steel or some other relatively rigid substance. In this case, as shown in FIG. 8, resilient means such as resilient rings or grommets 22, 22′ are provided in the bores 5, 5′ and/or resilient means such as resilient inserts 23, 23′ are provided on the surfaces 9, 9′, to ensure that the shuttle housing is in compression between the pin 7 and the surfaces 9, 9′. Where grommets 22, 22′ are used, a different method of assembly must be used, since the grommets 22, 22′ cannot be stressed by applying a compressive force to the shuttle housing. One method of stressing the grommets is to insert a tapered drift into the bores 5, 5′, 5″. By making the pin 7 hollow and providing a concentric spigot at the large end of the drift on which the pin 7 can be mounted, the pin 7 can follow the drift into the bores. Because of the resilient deformation of the shuttle housing or of the rings 22, 22′, the pin 7 always presses in the same direction against the walls of the bores 5, 5′, 5″.

The shuttle housing is constructed to be an expendable wearing element. To dismantle the shuttle, the pin 7 can be pressed or drilled out whereafter the gripper spring can be re-assembled in a new body.

The wide sidewalls 10, 10′ at the rear end of the shuttle housing are each formed with a slot 11, 11′ so that the jaws 2, 2′ can receive the end of a weft thread from a thread feeder (not shown) after the spring arms 1, 1′ have been opened by the introduction of a wedge-shaped spring opener (not shown) through bores 12, 12′ in the side walls 10, 10′ and between the arms 1, 1′. The spring opener acts on two thickened parts 13, 13′ which are provided on the arms 1, 1′. The spring arms 1, 1′ have similar thickened parts 14, 14′ near the slots 11, 11′ on which a spring opener on the catching side acts upon the completion of the pick.

The narrow sidewalls 6, 6′ of the shuttle housing have flange-like thickenings 16, 16′ at the rear end where the picking stick (not shown) strikes the shuttle for picking.

Referring to FIG. 4, the overall thickness of the shuttle, i.e. the distance between the surface of the wider sidewalls 10, 10′, which are the surfaces which cooperate with the guide teeth and catching brake, is greater than the greatest thickness of the nose member 8. Thus, there can be no direct contact between, on the one hand, the shuttle nose member and, on the other hand, the guide teeth or braking jaws.

Figure 5:
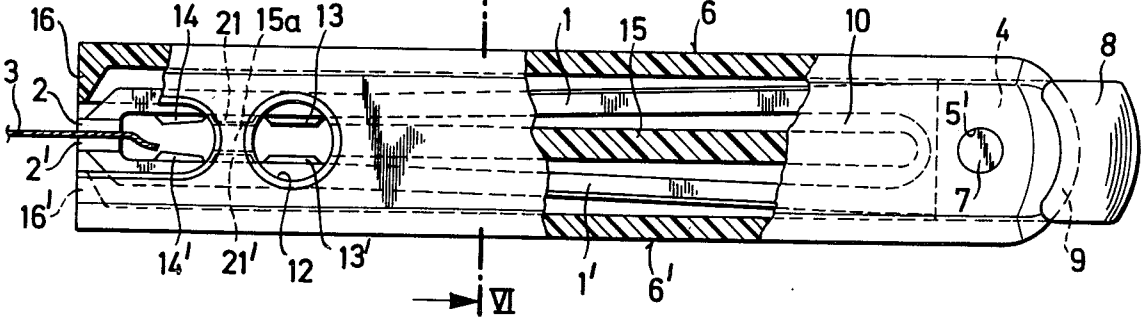
FIG. 5 illustrates a view similar to FIG. 1 of a second embodiment of the invention but partly sectioned.

In the embodiment shown in FIGS. 1 to 4, the shape of the bearing surfaces 9, 9' is such that the engagement between these surfaces and the front end of the shuttle housing is sufficient to retain the gripper spring with sufficient accuracy in the correct position in the shuttle housing, i.e. in the position in which the jaws 2, 2' can engage properly with the end of the fed weft thread 3. In the construction shown in FIG. 5, however, the bearing surfaces 9, 9' are curved about an axis lying near the axis of the pin 7. This feature enables the central part of the nose member 8 to be made of shorter length as measured in the direction of movement of the shuttle, than in the case of a nose member of the same weight having planar surfaces 9, 9'. Thus, the pin 7 can be moved nearer the front of the nose member 8. The yoke 4 is much shorter than in the shuttle shown in FIG. 1. While the shuttles shown in FIGS. 1 and 5 have the same external dimensions, the spring arms 1, 1' shown in FIG. 5 are considerably longer than those shown in FIG. 1, so that for a given maximum stressing of the spring arms, a higher clamping force is available when the spring is in the closed state.

Figure 6:
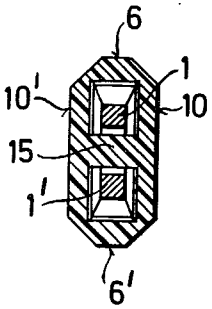
FIG. 6 illustrates a view taken on line VI—VI of FIG. 5.

Also, as has been proposed in U.S. Pat. No. 3,854,506 the shuttle housing shown in FIGS. 5 and 6 has a longitudinal wall or abutment 15 which is secured to and extends between the side walls 10 and 10' to increase the rigidity of the shuttle housing. The abutment 15 is interrupted to avoid obstructing the bores 12, 12'. The part of the abutment 15 to the rear of the bores is denoted 15*a*. Any tendency of the gripper spring to shift from a normal position in which the spring is symmetrical of the shuttle axis is limited by the abutment 15*a*. A thickened part or hard-metal tip 21, 21' is also provided on the inside of each of the arms 1, 1' and contacts the abutment 15*a* in the event of a slight misalignment of the spring. It is of course possible to provide an abutment such as 15*a* without providing a wall over the rest of the length of the shuttle housing.

It is also possible to provide a stiffening wall in the body of the shuttle shown in FIGS. 1 to 4.

The invention thus provides a shuttle in which the edge of the front end of the housing is overlaid by the rear end of the nose member to avoid the occurrence of a gap therebetween during use.

What is claimed is:

1. A gripper shuttle for picking weft yarns in a weaving machine comprising a shuttle body housing of tubular construction having a front end;

a nose member at said front end of said housing and having inwardly and rearwardly facing inclined surfaces thereon engaging at least part of said front end of said housing;

a spigot within said front end of said housing secured to said nose member; and means securing said spigot to said housing to press said surfaces of said housing and said nose member together under a longitudinally directed compressive force.

2. A gripper shuttle as set forth in claim 1 wherein said spigot and said housing include bores therein and said means comprises a pin disposed in said bores to retain said spigot in said housing, said bore in said spigot normally being displaced relative to said bores in said housing in a direction towards said front end to place said housing under a compressive force between said pin and said nose member when said pin is in place.

3. A gripper shuttle as set forth in claim 2 wherein said housing is made of a tough impact-resistant plastics material.

4. A gripper shuttle as set forth in claim 1 wherein said nose member has a smaller longitudinal cross-section than said housing.

5. A gripper shuttle as set forth in claim 4 wherein said front end of said housing has outwardly and forwardly facing inclined surfaces engaging said surfaces of said nose member.

6. A gripper shuttle as set forth in claim 1 wherein said housing has an oblong cross-section and engages with said surfaces of said nose member along the wider sidewalls thereof.

7. A gripper shuttle as set forth in claim 6 wherein said housing is of a thickness transverse to said wider sidewalls greater than the transverse thickness of said nose member.

8. A gripper shuttle as set forth in claim 6 wherein said surfaces of said nose member are curved about an axis extending perpendicularly to said wider sidewalls and rearwardly of said nose member relative to said housing.

9. A gripper shuttle as set forth in claim 1 wherein said spigot is in the form of a yoke connecting two gripper spring arms, said arms being disposed within said housing and including gripping jaws for gripping a weft yarn.

10. A gripper shuttle as set forth in claim 9 which further comprises an abutment integrally mounted to and within said housing between said arms for abutting of said arms thereagainst upon closing of said jaws together.

11. A gripper shuttle as set forth in claim 10 wherein said housing is of oblong cross-section with a pair of opposite wide sidewalls and said abutment interconnects said sidewalls and extends longitudinally of said housing.

12. A gripper shuttle comprising a housing of synthetic plastics material having a front end;

a nose member projecting from said front end of said housing having surfaces overlying at least part of a forward edge of said front end and being of a reduced transverse cross-section relative to the transverse cross-section of said housing; and means for securing said nose member to said housing to press said surfaces of said housing and said nose member together under a longitudinally directed compressive force.

13. A gripper shuttle comprising a shuttle body housing of tubular construction and of a tough impact-resistant resilient plastics material, said housing having a front end and a pair of oppositely aligned bores therein;

a metal nose member at said front end of said housing having inwardly and rearwardly facing inclined surfaces thereon engaging at least part of said front end of said housing;

a spigot secured to said nose member and mounted within said housing, said spigot having a bore therein normally disposed nearer said surfaces of said nose member than said bores of said housing;

and a pin passing through said bores of said housing and said spigot to connect said housing to said spigot while longitudinally compressing said housing between said pin and said nose member.

14. A gripper shuttle as set forth in claim 13 wherein said nose member is of less thickness than said housing.

15. A gripper shuttle comprising a shuttle body housing of tubular construction and of relatively rigid substance, said body having a front end and a pair of oppositely aligned bores therein;

a metal nose member at said front end of said housing having inwardly and rearwardly facing inclined surfaces thereon engaging at least part of said front end of said housing;

a spigot secured to said nose member and mounted within said housing, said spigot having a bore therein normally disposed nearer said surfaces of said nose member than said bores of said housing;

resilient means disposed in said pair of bores and/or on said surfaces; and a pin passing through said bores of said housing and said spigot to connect said housing to said spigot while compressing said resilient means to place said housing in compression between said pin and said surfaces.

* * * * *

UNITED STATES PATENT AND TRADEMARK OFFICE

CERTIFICATE OF CORRECTION

PATENT NO. : 3,939,878

DATED : February 24, 1976

INVENTOR(S) : Erwin Pfarrwaller

It is certified that error appears in the above-identified patent and that said Letters Patent are hereby corrected as shown below:

Column 2, line 26, "housng" should be --housing--.

Column 3, line 6, "an" should be --can--.

Column 3, line 8, "for" should be --form--.

Signed and Sealed this

Twenty-fourth Day of August 1976

[SEAL]

*Attest:*

RUTH C. MASON
*Attesting Officer*

C. MARSHALL DANN
*Commissioner of Patents and Trademarks*